US011248478B2

(12) United States Patent
Maurya et al.

(10) Patent No.: US 11,248,478 B2
(45) Date of Patent: Feb. 15, 2022

(54) TURBINE EXHAUST CRACK MITIGATION USING PARTIAL COLLARS

(71) Applicant: Siemens Aktiengesellschaft, Munich (DE)

(72) Inventors: Shashikant Maurya, Raigad (IN); John Giaimo, Palm Beach Gardens, FL (US); Ryan David Wiebe, Palm Beach Gardens, FL (US); Keith L. Nickols, Winter Park, FL (US); Andre Correa, Wellington, FL (US)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/734,947

(22) PCT Filed: Jun. 7, 2019

(86) PCT No.: PCT/US2019/035908
§ 371 (c)(1),
(2) Date: Dec. 3, 2020

(87) PCT Pub. No.: WO2019/236928
PCT Pub. Date: Dec. 12, 2019

(65) Prior Publication Data

US 2021/0231021 A1 Jul. 29, 2021

(30) Foreign Application Priority Data

Jun. 7, 2018 (IN) ..... 201811021368

(51) Int. Cl.
*F01D 9/04* (2006.01)
*F01D 9/06* (2006.01)
(Continued)

(52) U.S. Cl.
CPC ..... *F01D 9/04* (2013.01); *F01D 9/06* (2013.01); *F01D 25/24* (2013.01); *F01D 25/26* (2013.01);
(Continued)

(58) Field of Classification Search
CPC ... F01D 9/04; F01D 9/06; F01D 25/24; F01D 25/243; F01D 25/26; F01D 25/30;
(Continued)

(56) References Cited

U.S. PATENT DOCUMENTS 5,335,490 A * 8/1994 Johnson ..... F01D 9/065 60/740
6,866,479 B2 * 3/2005 Ishizaka ..... F01D 25/30 415/209.1
(Continued)

FOREIGN PATENT DOCUMENTS

WO 2014197037 A2 12/2014

OTHER PUBLICATIONS

PCT International Search Report and Written Opinion of International Searching Authority dated Aug. 23, 2019 corresponding to PCT International Application No. PCT/US2019/035908 filed Jun. 7, 2019.

*Primary Examiner* — Igor Kershteyn

(57) ABSTRACT

An exhaust apparatus for a gas turbine includes an annular duct with struts extending from an outer duct-wall to an inner duct-wall of the annular duct. Each strut is encapsulated in a respective strut shield. An interface of the strut shield with a respective duct-wall includes a collar extending along a partial length of the perimeter of the strut shield at the respective interface. The collar includes a first section extending radially and aligned with the strut shield, and a second section oriented at an angle to the first section and aligned with the respective duct-wall. The first section is attached to the strut shield along a first joint and the second section is attached to the respective duct-wall along a second
(Continued)

joint. An intersection of the first and second sections is formed by a smooth curve defined by a radius configured to distribute stresses at the respective interface.

17 Claims, 5 Drawing Sheets

(51) Int. Cl.
*F01D 25/24* (2006.01)
*F01D 25/26* (2006.01)
*F01D 25/30* (2006.01)

(52) U.S. Cl.
CPC ..... *F01D 25/30* (2013.01); *F05D 2220/32* (2013.01); *F05D 2230/72* (2013.01); *F05D 2240/14* (2013.01)

(58) Field of Classification Search
CPC ..... F05D 2220/32; F05D 2230/72; F05D 2230/232; F05D 2240/14
See application file for complete search history.

(56) References Cited

U.S. PATENT DOCUMENTS 7,891,165 B2 * 2/2011 Bader ..... F02C 7/00 60/39.5
8,408,011 B2 * 4/2013 Fontaine ..... F01D 25/162 60/796
2010/0275572 A1 * 11/2010 Durocher ..... F01D 25/18 60/39.08
2011/0016883 A1 * 1/2011 Clemen ..... F01D 25/162 60/796
2012/0198810 A1 * 8/2012 Ansari ..... F01D 25/162 60/39.5
2015/0040393 A1 * 2/2015 Shteyman ..... F01D 25/30 29/888.02
2015/0044039 A1 * 2/2015 Shteyman ..... F01D 25/30 415/207
2015/0044046 A1 2/2015 Shteyman et al.
2015/0143815 A1 5/2015 Salunkhe et al.

* cited by examiner

View III-III

TURBINE EXHAUST CRACK MITIGATION USING PARTIAL COLLARS

BACKGROUND

1. Field

The present invention relates to gas turbine engines, and in particular to an exhaust apparatus of a gas turbine engine.

2. Description of the Related Art

An axial flow turbomachine, such as a gas turbine engine, typically includes a compressor section for compressing air, a combustor section for mixing the compressed air with fuel and igniting the mixture to form a hot working medium fluid, a turbine section for extracting power from the working medium fluid, and an exhaust apparatus located downstream of a last turbine stage for channeling the turbine exhaust flow. The turbine exhaust apparatus typically includes supporting structures, such as struts, distributed circumferentially in an annular flowpath. Each strut extends through an outer flowpath boundary and an inner flowpath boundary and is encapsulated by a protective strut shield. The strut shield may be joined to the outer and inner flowpath boundaries, for example by welding.

SUMMARY

Briefly, aspects of the present invention are directed to an apparatus and method for mitigating cracking in a gas turbine engine exhaust.

According to a first aspect of the invention, an exhaust apparatus for a gas turbine is provided. The exhaust apparatus comprises an annular duct extending axially along a machine axis of the gas turbine. The annular duct is radially delimited by an outer duct-wall and an inner duct-wall. The exhaust apparatus also comprises a plurality of struts, which are circumferentially distributed within the annular duct. Each strut extends at least from the outer duct-wall to the inner duct-wall and is encapsulated in a respective strut shield. Each strut shield engages with the outer duct-wall along a first interface and engages with the inner duct-wall along a second interface. At least one of the first and second interfaces comprises at least one collar extending along a partial length of the perimeter of the strut shield at the respective interface. The collar comprises a first section extending radially and being aligned with the strut shield, and a second section oriented at an angle to the first section and being aligned with the respective duct-wall. The first section is attached to the strut shield along a first joint and the second section is attached to the respective duct-wall along a second joint. An intersection of the first and second sections is formed by a smooth curve defined by a radius configured to distribute stresses at the respective interface.

According to a second aspect of the invention, a method is provided for servicing a gas turbine to mitigate cracking in an exhaust apparatus of the gas turbine. The exhaust apparatus includes an annular duct extending axially along a machine axis of the gas turbine. The annular duct is radially delimited by an outer duct-wall and an inner duct-wall. The exhaust apparatus also includes a plurality of struts, which are circumferentially distributed within the annular duct. Each strut extends at least from the outer duct-wall to the inner duct-wall and is encapsulated in a respective strut shield. Each strut shield engages with the outer duct-wall along a first interface and engages with the inner duct-wall along a second interface. The method comprises attaching at least one collar at the first interface and/or at the second interface. The collar is attached such that, after attachment, the collar extends along a partial length of the perimeter of the strut shield at the respective interface. The collar comprises a first section and a second section oriented at an angle to the first section. Attaching the collar comprises: aligning the first section with the strut shield and aligning the second section with the respective duct-wall, and subsequently joining the first section to the strut shield along a first joint and joining the second section to the respective duct-wall along a second joint. An intersection of the first and second sections is formed by a smooth curve defined by a radius configured to distribute stresses at the respective interface.

BRIEF DESCRIPTION OF THE DRAWINGS

The invention is shown in more detail by help of figures. The figures show preferred configurations and do not limit the scope of the invention.

DETAILED DESCRIPTION

In the following detailed description of the preferred embodiments, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Figure 1:
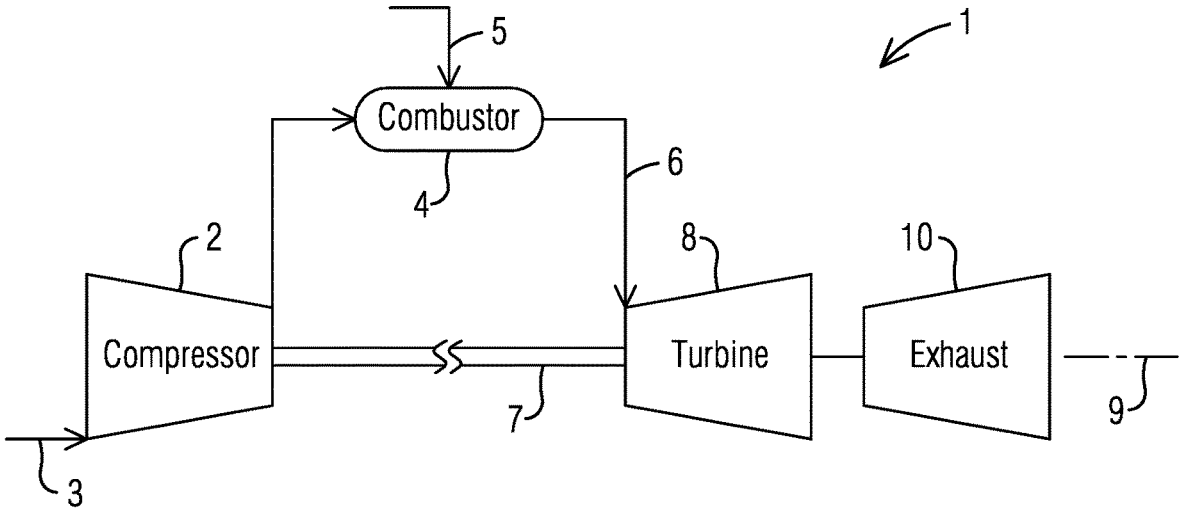
FIG. 1 is a schematic diagram of a gas turbine engine where embodiments of the present invention may be incorporated.

Referring to FIG. 1, a gas turbine engine 1 generally includes a compressor section 2, a combustor section 4, a turbine section 8 and an exhaust apparatus 10. In operation, the compressor section 2 inducts ambient air 3 and compresses it. The compressed air from the compressor section 2 enters one or more combustors in the combustor section 4. The compressed air is mixed with the fuel 5, and the air-fuel mixture is burned in the combustors to form a hot working medium fluid 6. The hot working medium fluid 6 is routed to the turbine section 8 where it is expanded through alternating rows of stationary airfoils and rotating airfoils and used to generate power that can drive a rotor 7. The expanded gas exiting the turbine section 8 is exhausted from the engine 1 via the exhaust apparatus 10 which is located downstream of a last turbine stage.

Figure 2:
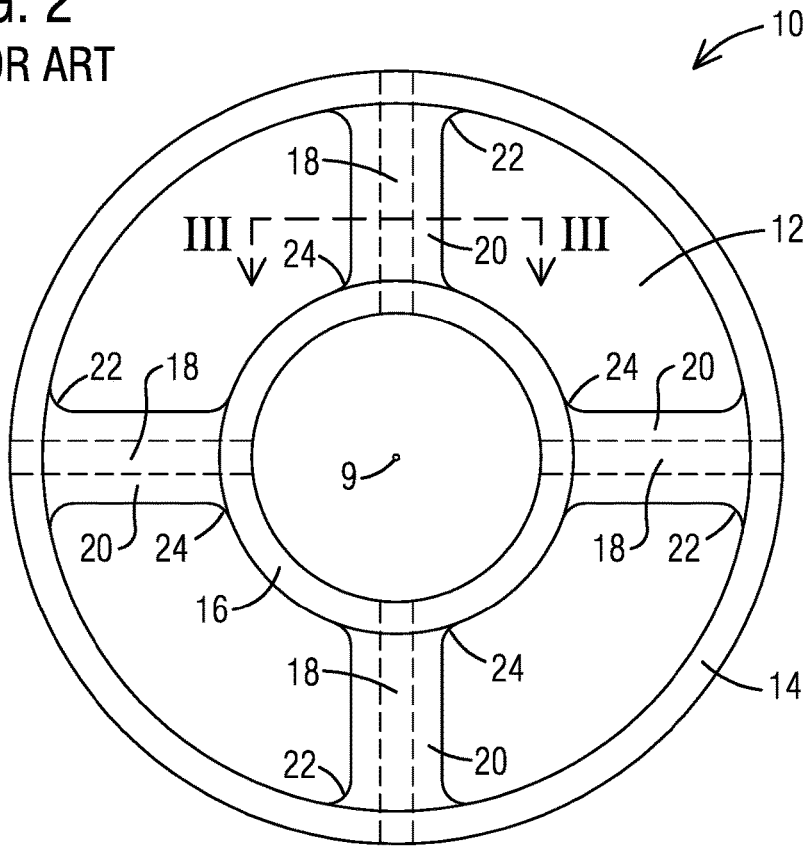
FIG. 2 PRIOR ART
FIG. 2 is an axial front view of a known type of exhaust apparatus.
Figure 3:
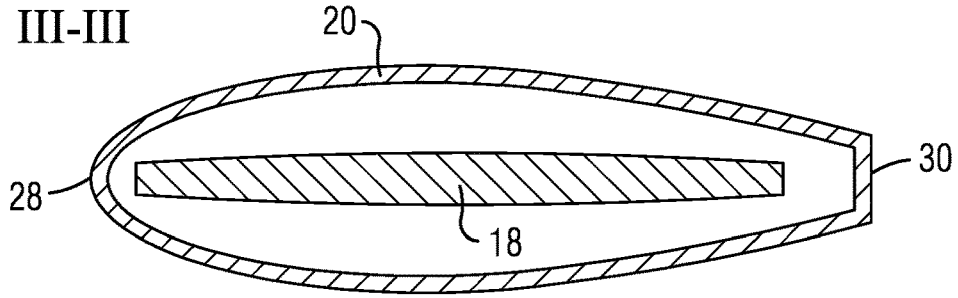
FIG. 3 is a cross-sectional view along the section in FIG. 2.

In one example, as shown in FIGS. 1 and 2, the exhaust apparatus 10 may be configured as a diffuser, which may include a divergent annular duct 12 defining a flowpath for the exhaust gas and extending axially along a machine axis 9 of the gas turbine engine 1. The annular duct 12 is delimited radially by an outer duct-wall 14 forming an outer flowpath boundary and an inner duct-wall 16 forming an inner flowpath boundary. The divergent annular duct 12 may serve to reduce the speed of the exhaust flow and thus increase the pressure difference of the exhaust gas expanding across the last stage of the turbine section 8. The exhaust apparatus 10 further includes supporting structures, such as struts 18, which are distributed circumferentially within the annular duct 12. Each strut 18 extends at least from the outer duct-wall 14 to the inner duct-wall 16. In the shown example, the struts 18 further extend through the outer duct-wall 14 and the inner duct-wall 16. To protect the struts 18 from high exhaust flowpath temperatures, each strut 18 is typically enclosed by a strut shield 20. The strut shield 20 may be aerodynamically shaped, having a leading edge 28 and a trailing edge 30, as shown in the cross-sectional view in FIG. 3. Referring to FIG. 2, the strut shield 20 encapsulates the radial extent of the strut 18 between the outer duct-wall 14 and the inner duct-wall 16. Each strut shield 20 engages with the outer duct-wall 14 along an outer interface 22 and engages with the inner duct-wall 16 along an inner interface 24. The interfaces 22, 24 are typically formed by weld joints.

It has been observed that strut shields in the turbine exhaust frequently exhibit cracking after extended operation in the field. These cracks tend to form in highly stressed regions, especially at the weld joints at the outer and inner interfaces 22 and 24 respectively. In particular, the present inventors have recognized that the cracks primarily initiate at the leading edge 28 and at the trailing edge 30 of the strut shield 20 at the interfaces 22, 24. The cracking may be attributed to high thermal gradients in these areas, poor weld quality, and high vibrations. The above factors may act independently or in combination to create conditions for exhaust cracking. Exhaust cracking in the field has been typically addressed by weld repair in the field. However, this process can be time consuming and expensive, with repaired areas sometimes re-cracking once engine operation resumes.

Embodiments of the present invention illustrated in FIG. 4-10 are directed to a load distributing collar 26 attachable at any of the interfaces 22, 24 to mitigate cracking in these regions. The collar 26 is designed so as to move the joints (typically weld joints) away from the highly stressed locations and provide a broad, smooth radius to better distribute stresses in these areas. A distinct feature of the proposed design is that the collar 26 does not extend along the entire perimeter of the strut shield 20 at the respective interface 22, 24, but is only provided along a partial length of the perimeter thereof. The partial collar design may ensure reduced potential of exhaust distortion from material removal, weld shrinkage and residual stresses when compared to a full load collar design (i.e. one in which the collar extends along the full perimeter of the strut shield). The partial collar design may also ensure lower risk of weld joint mismatch due to surface tolerance deviations with adjacent hardware when compared to a full load collar design. At least for the above reasons, a partial collar 26, as illustrated herein, may be easily installed on site during a field service.

In one embodiment, a partial collar 26 may be provided at the locations having the highest stresses, for example at the leading edge 28 and/or at the trailing edge 30 of the strut shield 20, at either or both of the interfaces 22, 24. Thereby, stresses in the leading edge 28 and/or the trailing edge 30 may be redistributed to other locations of the strut shield 20 and the respective duct-wall 14, 16, thereby directly addressing and eliminating cracking risk currently witnessed in these areas. Furthermore, equivalent strength of flowpath cross-section at the leading edge 28 and the trailing edge 30 may be increased due to decrease in weld material proportion at these locations. Equivalent strength of a flowpath cross-section refers the net strength of the flowpath cross-section considering the non-homogeneity (strength weakening elements), for example, due to weld seam heat affected zones, porosity, or other defects. Embodiments of the invention attempt to limit the extent of non-homogeneity, especially at the leading edge and/trailing edge of the strut shield at the joints, due to smaller proportion of weld areas relative to conventional design approach, where the strut shield is joint to duct-wall directly by a weld at the leading and trailing edges.

Figure 5:
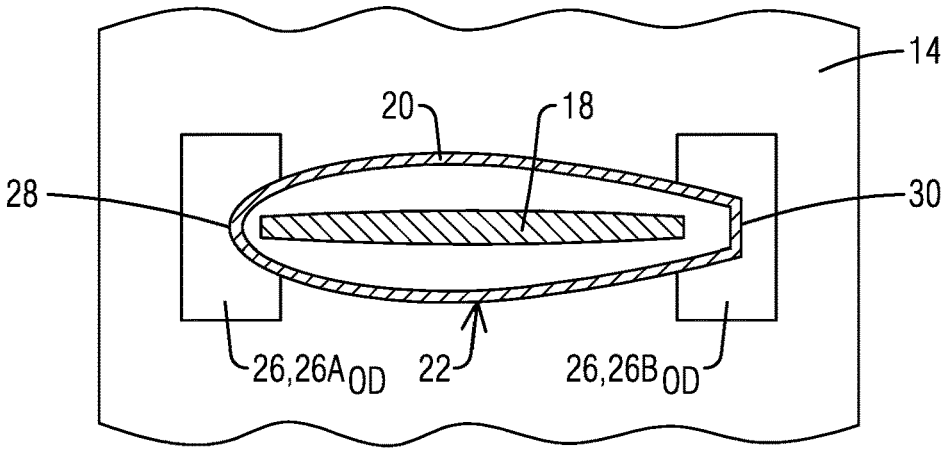
FIG. 5 is a sectional plan view, looking in a radially outward direction, depicting a pair of partial collars at an interface of a strut shield with an outer duct-wall.
Figure 6:
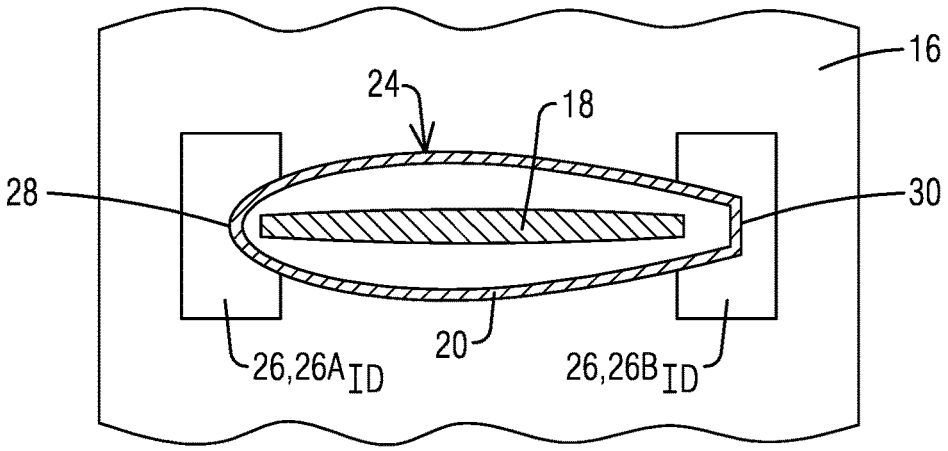
FIG. 6 is a sectional plan view, looking in a radially inward direction, depicting a pair of partial collars at an interface of a strut shield with an inner duct-wall.
Figure 4:
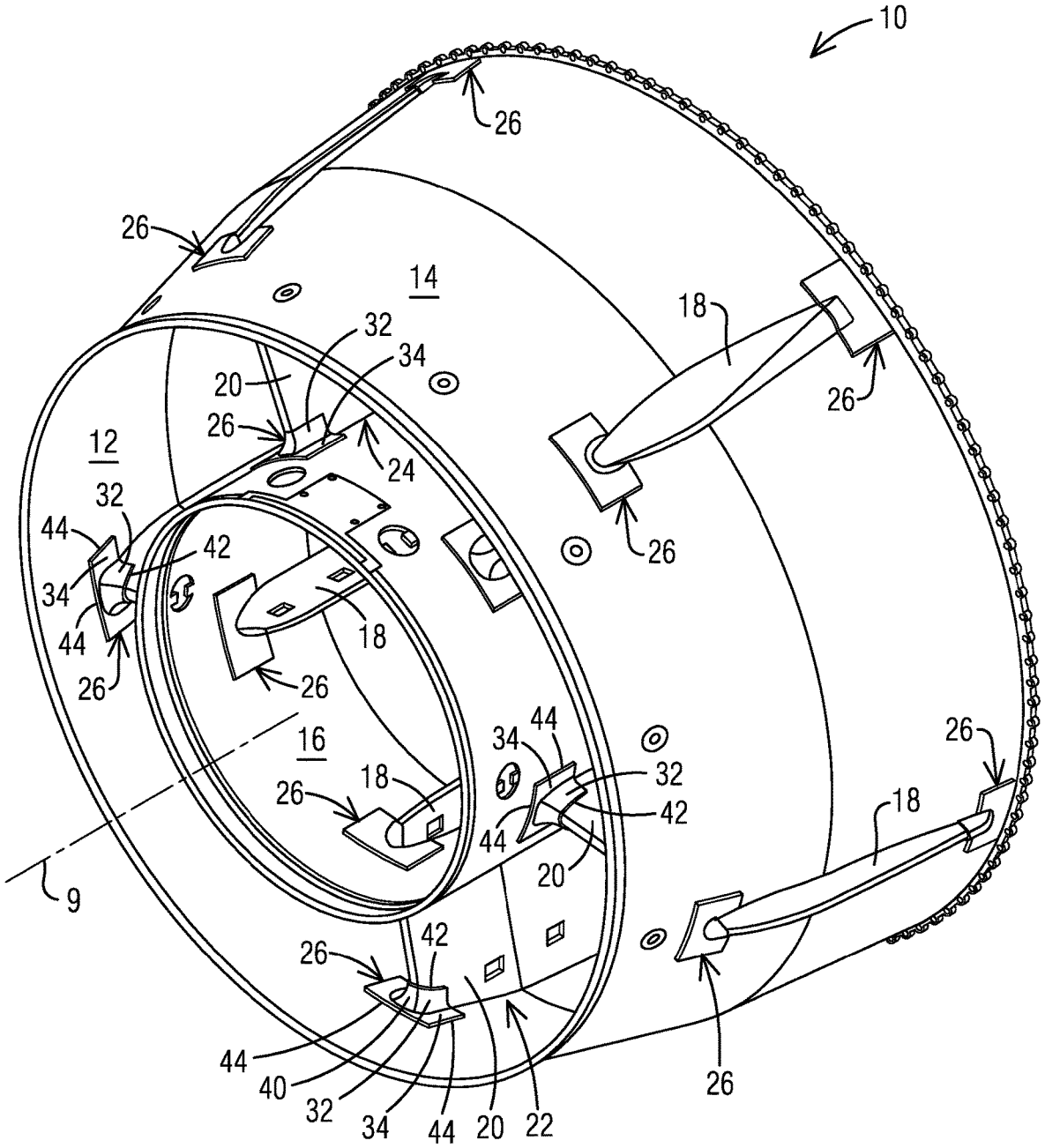
FIG. 4 is a perspective view of an exhaust apparatus comprising partial collars according an embodiment of the present invention.

FIG. 4-6 illustrate an exemplary embodiment employing the proposed partial collar design. In the illustrated embodiment, each strut shield 20 is associated with four collars 26, which include a pair of collars 26 at each interface 22, 24 with the respective duct-wall 14, 16. As particularly shown in FIGS. 5 and 6, the outer interface 22 of the strut shield 20 and the outer duct-wall 14 comprises: a leading edge collar $\mathbf{26}A_{OD}$ extending around the leading edge 28 of the strut shield 20, and a trailing edge collar $\mathbf{26}B_{OD}$ extending around the trailing edge 30 of the strut shield 20. In addition, the inner interface 24 of the strut-shield 20 and the inner duct-wall 16 comprises: a leading edge collar $\mathbf{26}A_{ID}$ extending around the leading edge 28 of the strut shield 20, and a trailing edge collar $\mathbf{26}B_{ID}$ extending around the trailing edge 30 of the strut shield 20. In other embodiments (not shown), a collar 26 may be provided at any one or more of the afore-mentioned locations, or at any other location with high stress which is prone to cracking.

Figure 8:
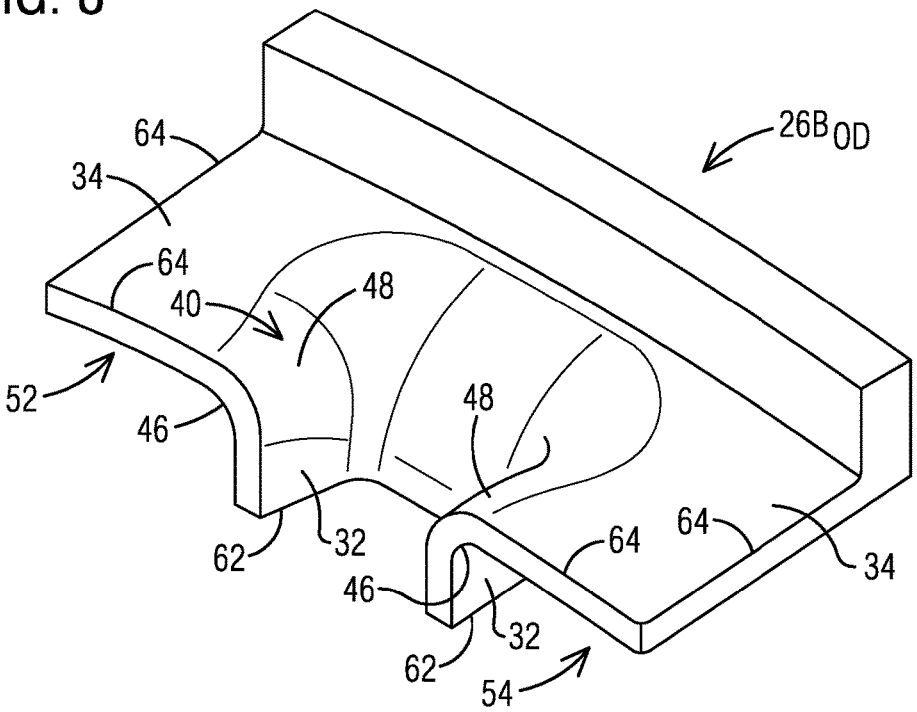
FIG. 8-10 are perspective views of partial collars according to various embodiments of the present invention.
Figure 9:
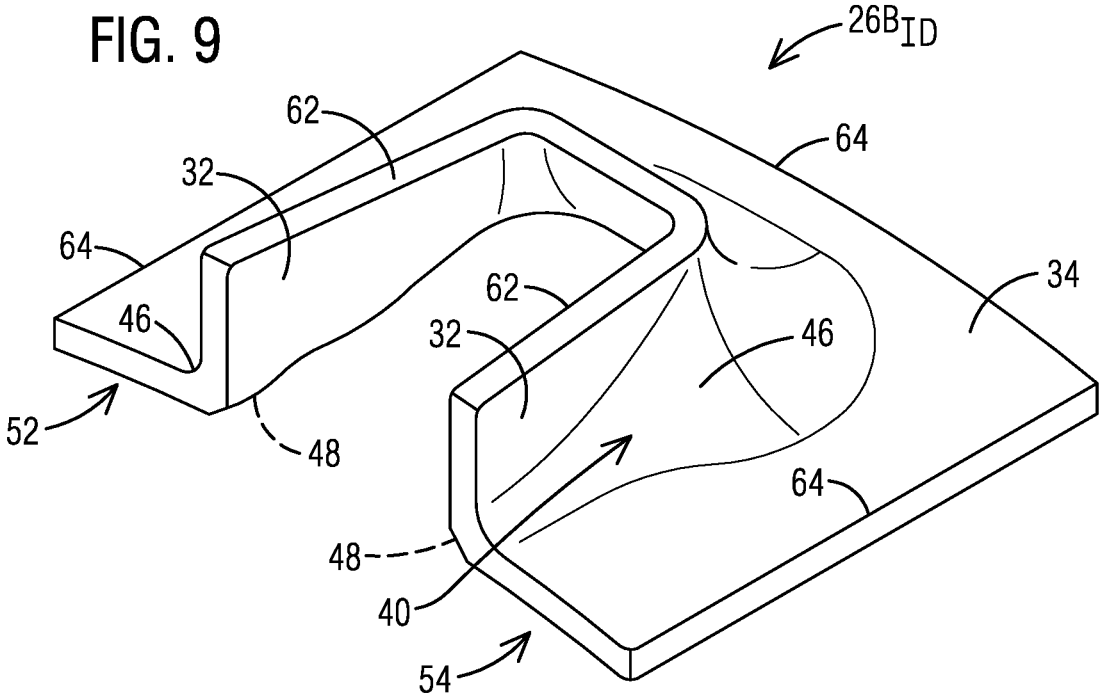

FIGS. 8 and 9 depict exemplary embodiments of a partial collar 26 in accordance with aspects of the present invention. In particular, FIG. 8 depicts a trailing edge collar $\mathbf{26}B_{OD}$ attachable to the trailing edge 30 of the strut shield 20 at the outer interface 22, while FIG. 9 depicts a trailing edge collar $\mathbf{26}B_{ID}$ attachable to the trailing edge 30 of the strut shield 20 at the inner interface 24. The collars $\mathbf{26}B_{OD}$ and $\mathbf{26}B_{ID}$ may be shaped so as to match a contour of the trailing edge 30 of the strut shield 20 at the interfaces 22 and 24 respectively. Although not illustrated in detail in the drawings, the leading edge collars $\mathbf{26}A_{OD}$ and $\mathbf{26}A_{ID}$ shown in FIG. 4-6 may be similarly configured in principle, and adapted to match a contour of the leading edge 28 of the strut shield 20 at the interfaces 22 and 24 respectively.

Referring to FIGS. 8 and 9, each collar 26 comprises a first section 32 extending radially and configured to be aligned with the strut shield 20, and a second section 34 oriented at an angle to the first section 32 and configured to be aligned with the respective duct-wall 14, 16. The angle between the first section 32 and the second section 34 may correspond to the angle between the strut shield 20 and the duct-wall 14, 16 at the respective interface 22, 24. For example, the angle between the first section 32 and the section 34 may be about 90 degrees, though not necessarily equal to 90 degrees, due to the conical geometry of the duct-walls 14, 16. In case of a collar 26 attached to the outer interface 22, the first section 32 extends radially inward from the second section 34, as shown in FIG. 8. In case of a collar 26 attached to the inner interface 24, the first section 32 extends radially outward from the second section 34, as shown in FIG. 9. The first section 32 of each collar 26 has a first edge 62, which may be joined to the strut shield 20 along a first joint 42 (see FIG. 4). The second section 34 of each collar 26 has a second edge 64, which may be joined to the respective duct-wall 14, 16 along a second joint 44 (see FIG. 4). In one embodiment, the joints 42 and 44 comprise weld joints.

The first section 32 and the second section 34 of each collar 26 meet at an intersection 40. The intersection 40 is formed by a smooth curve defined by a radius configured to distribute stresses at the respective interface 22, 24. In the exemplary embodiment, the first joint 42 (along edge 62) is spaced from the intersection 40 along a first direction, and the second joint 44 (along edge 64) is spaced from the intersection 40 along a second direction non-parallel to the first direction. The illustrated collar design thus moves the weld joints away from the previously highly stressed areas to areas with lower stress, and provides a broad, smooth radius to better distribute stresses in these areas. As stated above, each collar 26 extends only along a partial length of the perimeter of the strut shield 20 at the respective interface 22, 24. Referring to FIG. 4-6, the strut shield 20 may be directly attached to the respective duct-wall 14, 16 for a remaining length of the perimeter of the strut shield 20 at the respective interface 22, 24, for example by welding.

Each collar 26 extends partially along the perimeter of the strut shield 20 from a first end 52 to a second end 54 of the collar 26, as shown in FIGS. 8 and 9. In one embodiment, as illustrated herein, the radius of the intersection 40 varies continuously between the first and second ends 52, 54. In particular, a maximum radius of the intersection 40 may be located at a location between the first and second ends 52, 54. For the trailing edge collars 26$B_{OD}$ and 26$B_{ID}$ (see FIGS. 8 and 9 respectively), the maximum radius may be located at the location of the trailing edge 30 of the strut shield 20. Likewise, for the leading edge collars 26$A_{OD}$ and 26$A_{ID}$ (not specifically shown), the maximum radius may be located at the location of the leading edge 28 of the strut shield 20.

The variation of radius and the maximum radius of each collar 26 may be individually configured to distribute stresses from the regions of highest stress. For example, the maximum radius of an individual collar 26 may depend on the location of the collar 26 (e.g., leading edge or trailing edge, inner or outer interface), span-wise height of the strut shield 20, and the material thickness of the strut shield 20, among other factors. In one embodiment, the maximum radius of a collar 26 may be configured such that a ratio of a span-wise height of the strut shield 20 at the location of the maximum radius to the maximum radius lies in the range of 7-16. Independently or in addition, the maximum radius of a collar 26 may be configured such that a ratio of the maximum radius to a material thickness of the strut shield lies in the range of 4-10. It may be noted that in a divergent duct geometry, the span-wise height of the strut shield typically increases from the leading edge to the trailing edge. The material thickness of the strut shield may, in most cases, be assumed to be substantially constant. Moreover, radius of each collar 26 may be desirably tailored relative to existing adjacent hardware to help further reduce stresses in specific areas. Accordingly, in one embodiment, the radius at the first end 52 and the radius at the second end 54 of the collar 26 are configured to respectively match the radius of a joint between the strut shield 20 and the respective duct-wall 14, 16 adjacent to the first end 52 and the radius of a joint between the strut shield 20 and the respective duct-wall 14, 16 adjacent to the second end 54 of the collar 26.

In the present embodiment, as shown in FIGS. 8 and 9, the smooth curve forming the intersection 40 is defined by an inner radius on a first surface 46 facing a flowpath and an outer radius on a second surface 48 opposite to the first surface 46. In this case, the term "radius", as used in present specification, in phrases such as "variation of radius", "maximum radius", and the like, may refer to the inner radius, or the outer radius, or both.

Figure 10:
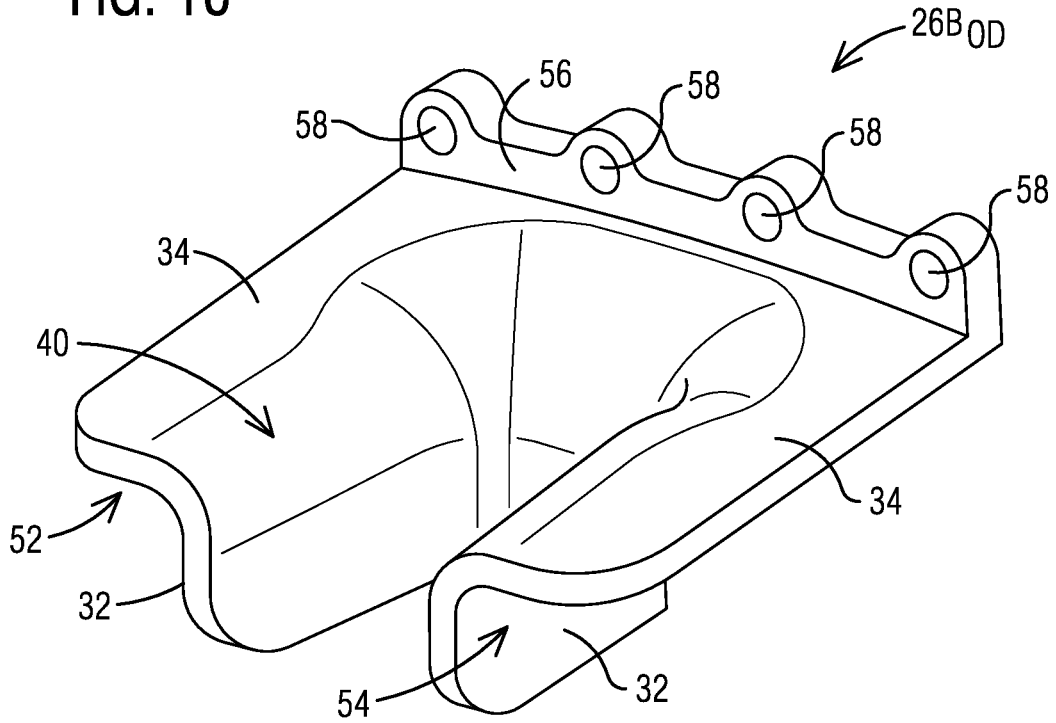

In a further embodiment, the aft end of the trailing edge collars, particularly the trailing edge collars 26$B_{OD}$ located at the outer interface 24, may be configured as a radially extending flange 56, as shown in FIG. 10. The flange 56 may be provided with bolt-holes 58 for attaching the duct 12 to a casing of a downstream turbine exhaust manifold.

A further aspect of the present invention may be directed to a method to mitigate cracking in a turbine exhaust apparatus. The proposed method may be employed, for example, as part of an on-site field servicing of a gas turbine engine.

Figure 7:
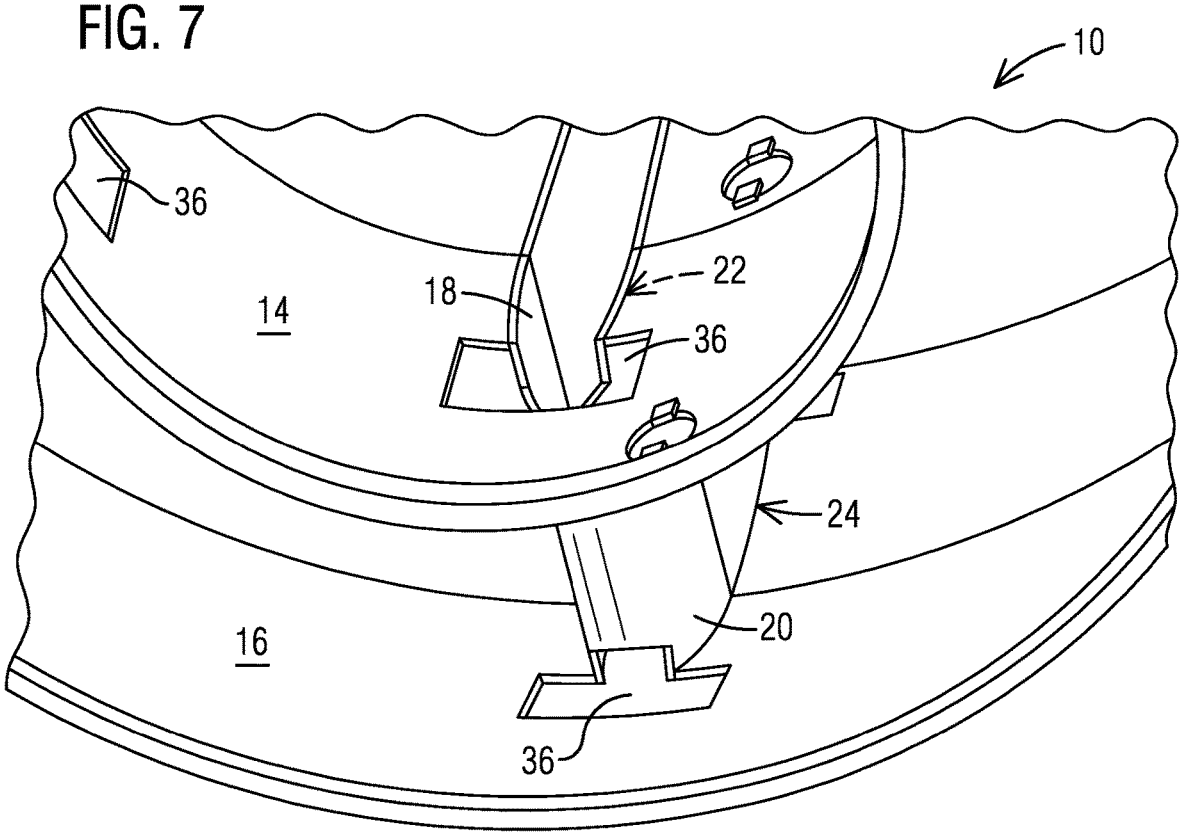
FIG. 7 is a perspective view of an exhaust apparatus with machined cutouts prior to attachment of the partial collars.

In a first step, as shown in FIG. 7, one or more cutouts 36 may be formed, for example, by machining the strut shield 20 and the respective duct wall 14, 16. The cutouts 36 may be formed at the locations where the collars 26 are intended to be subsequently attached. The machining of the strut shield 20 and the respective duct-wall 14, 16 may be performed such that a peripheral contour of the cutout 36 as a whole corresponds to a peripheral contour of the respective collar 26 to be attached at the location of the cutout 36. In the illustrated embodiment, the cutouts 36 are formed at the leading edge 28 and at the trailing edge 30 at the outer interface 22 as well as the inner interface 24 of each strut shield 20. Each strut shield 20 is, in this case, associated with four cutouts 36. A subsequent step comprises positioning the collars 26 within the cutouts 36 by aligning the first section 32 of each collar 26 with the strut shield 20 and aligning the second section 34 of the collar 26 with the respective duct-wall 14, 16. The first section 32 of the collar 26 is then joined to the strut shield 20 along a first joint 42 and the second section 34 of the collar 26 is joined to the respective duct-wall 14, 16 along a second joint 44. In the illustrated embodiment, said joining may be carried out by welding. The resultant configuration of the exhaust apparatus 10 is shown in FIG. 4.

The above-described embodiments relate to a turbine exhaust cylinder positioned immediately downstream of a last turbine stage. It may be appreciated that aspects of the present invention may be applied to other areas in a turbine exhaust apparatus that involve supporting struts, such as in a turbine exhaust manifold positioned downstream of a turbine exhaust cylinder.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. An exhaust apparatus for a gas turbine, comprising:

an annular duct extending axially along a machine axis of the gas turbine, the annular duct being radially delimited by an outer duct-wall and an inner duct-wall, a plurality of struts, which are circumferentially distributed within the annular duct, wherein each strut extends at least from the outer duct-wall to the inner duct-wall and is encapsulated in a respective strut shield, wherein each strut shield engages with the outer duct-wall along a first interface and engages with the inner duct-wall along a second interface, wherein at least one of the first and second interfaces comprises:

at least one collar extending along a partial length of the perimeter of the strut shield at the respective interface, the collar comprising a first section extending radially and being aligned with the strut shield, and a second section oriented at an angle to the first section and being aligned with the respective duct-wall, the first section being attached to the strut shield along a first joint and the second section being attached to the respective duct-wall along a second joint, and wherein an intersection of the first and second sections is formed by a smooth curve defined by a radius configured to distribute stresses at the respective interface.

2. The exhaust apparatus according to claim 1, wherein the first joint is spaced from the intersection along a first direction and the second joint is spaced from the intersection along a second direction which is non-parallel to the first direction.

3. The exhaust apparatus according to claim 1, wherein the strut shield is directly attached to the respective duct-wall for a remaining length of the perimeter of the strut shield at the respective interface.

4. The exhaust apparatus according to claim 1, wherein said at least one collar comprises one or both of:

a leading edge collar extending around a leading edge of the strut shield at the respective interface, and a trailing edge collar extending around a trailing edge of the strut shield at the respective interface.

5. The exhaust apparatus according to claim 4, wherein both the first interface and the second interface comprise a respective leading edge collar and a respective trailing edge collar.

6. The exhaust apparatus according to claim 1, wherein the first joint and the second joint each comprises a weld joint.

7. The exhaust apparatus according to claim 1, wherein the collar extends partially along the perimeter of the strut shield at the respective interface from a first end to a second end of the collar, wherein the radius of the intersection varies continuously between the first and second ends.

8. The exhaust apparatus according to claim 7, wherein a maximum radius of the intersection is located at a location between the first and second ends.

9. The exhaust apparatus according to claim 8, wherein the maximum radius is located at a leading edge or at a trailing edge of the strut shield.

10. The exhaust apparatus according to claim 8, wherein the maximum radius of the intersection is configured such that:

a ratio of a span-wise height of the strut shield at the location of the maximum radius to the maximum radius lies in the range of 7-16, and/or a ratio of the maximum radius to a material thickness of the strut shield lies in the range of 4-10.

11. The exhaust apparatus according to claim 7, wherein the radius of the intersection at the first end and the radius of the intersection at the second end of the collar are configured to respectively match the radius of a joint between the strut shield and the respective duct-wall adjacent to the first end and a radius of a joint between the strut shield and the respective duct-wall adjacent to the second end.

12. The exhaust diffuser according to claim 1, wherein the smooth curve forming the intersection is defined by an inner radius on a first surface facing a flowpath and an outer radius on a second surface opposite to the first surface.

13. The exhaust diffuser according to claim 1, wherein the at least one collar extends around a trailing edge of the strut shield at the first interface, and wherein an aft end of the collar comprises a radially extending flange provided with bolt holes for attachment to a downstream exhaust manifold.

14. A method for servicing a gas turbine to mitigate cracking in an exhaust apparatus of the gas turbine engine, the exhaust apparatus comprising:

an annular duct extending axially along a machine axis of the gas turbine, the annular duct being radially delimited by an outer duct-wall and an inner duct-wall, a plurality of struts, which are circumferentially distributed within the annular duct, wherein each strut extends at least from the outer duct-wall to the inner duct-wall and is encapsulated in a respective strut shield, wherein each strut shield engages with the outer duct-wall along a first interface and engages with the inner duct-wall along a second interface, the method comprising:

attaching at least one collar at the first interface and/or at the second interface, wherein after attachment, the collar extends along a partial length of the perimeter of the strut shield at the respective interface, wherein the collar comprises a first section and a second section oriented at an angle to the first section, wherein attaching the collar comprises:

aligning the first section with the strut shield and aligning the second section with the respective duct-wall, and joining the first section to the strut shield along a first joint and joining the second section to the respective duct-wall along a second joint, wherein an intersection of the first and second sections is formed by a smooth curve defined by a radius configured to distribute stresses at the respective interface.

15. The method according to claim 14, wherein the joining of the first section to the strut shield and the joining of the second section to the respective duct-wall comprise welding.

16. The method according to claim 14, comprising:

prior to said attaching of the at least one collar, forming a cutout in part on the strut shield and in part on the respective duct-wall, such that a peripheral contour of the cutout as a whole corresponds to a peripheral contour of the collar.

17. The method according to claim 16, wherein the cutout is formed by a machining operation.

* * * * *